US009194156B2

(12) United States Patent
Simon et al.

(10) Patent No.: US 9,194,156 B2
(45) Date of Patent: Nov. 24, 2015

(54) COVER TRIM FOR A PUSH BAR OF AN EXIT DEVICE

(71) Applicant: Triangle Brass Manufacturing Company, Inc., Los Angeles, CA (US)

(72) Inventors: Martin S. Simon, Long Beach, CA (US); Reed C. Baumgarten, Ione, CA (US); Vicente Delgadillo, Ensenada (MX)

(73) Assignee: Triangle Brass Manufacturing Company, Inc., Los Angeles, CA (US)

( * ) Notice: Subject to any disclaimer, the term of this patent is extended or adjusted under 35 U.S.C. 154(b) by 0 days.

(21) Appl. No.: 14/120,080

(22) Filed: Apr. 23, 2014

(65) Prior Publication Data

US 2014/0345087 A1 Nov. 27, 2014

Related U.S. Application Data

(60) Provisional application No. 61/855,787, filed on May 23, 2013.

(51) Int. Cl.

| | |
|---|---|
| ***A45C 13/26*** | (2006.01) |
| ***E05B 1/00*** | (2006.01) |
| ***E06B 7/28*** | (2006.01) |
| ***B24C 1/06*** | (2006.01) |
| ***B24B 29/06*** | (2006.01) |
| ***E05B 65/10*** | (2006.01) |

(52) U.S. Cl.

CPC ..... *E05B 1/0069* (2013.01); *B24B 29/06* (2013.01); *B24C 1/06* (2013.01); *E05B 65/1053* (2013.01); *E06B 7/285* (2013.01); *Y10T 16/458* (2015.01)

(58) Field of Classification Search

CPC ..... A45C 13/22; A45C 13/28; A45C 13/26; E05B 1/0066; E05B 1/0069; E05B 65/1053; B25G 1/10; B24C 1/06; B24B 29/06; Y10T 16/458; E06B 7/285

USPC ..... 16/412, 413, 422, 430, 435, 436, 902, 16/904

See application file for complete search history.

(56) References Cited

U.S. PATENT DOCUMENTS

| | | | | |
|---|---|---|---|---|
| 2,180,670 | A * | 11/1939 | Erickson | 40/599 |
| 4,167,280 | A | 9/1979 | Godec et al. | |
| 4,181,335 | A * | 1/1980 | Thoren | 292/92 |
| 6,645,435 | B2 * | 11/2003 | Dawson et al. | 422/110 |
| 6,817,066 | B1 * | 11/2004 | Williams et al. | 16/435 |
| 7,784,208 | B2 * | 8/2010 | Thompson | 40/599 |
| 8,375,521 | B1 * | 2/2013 | Caron | 16/435 |
| 8,695,168 | B1 * | 4/2014 | Cepeda | 16/435 |
| 8,714,215 | B2 * | 5/2014 | Badgley et al. | 150/154 |
| 2002/0092132 | A1 * | 7/2002 | Kessler | 16/436 |
| 2006/0006678 | A1 * | 1/2006 | Herron, Jr. | 292/336.3 |
| 2011/0067308 | A1 * | 3/2011 | Hunt et al. | 49/31 |

OTHER PUBLICATIONS

Harold Michels, "Antimicrobial Properties of Copper Alloys and Their Applications", print-out of PowerPoint presentaltion at UCLA Medical Center, Dec. 13, 2010 (58 pages).

(Continued)

*Primary Examiner* — Roberta Delisle
(74) *Attorney, Agent, or Firm* — David Weiss

(57) ABSTRACT

An easily installable and preferably antimicrobial cover trim for a push bar of an exit device for a door, as well as a method for increasing fingerprint resistance of metal touch surfaces.

24 Claims, 3 Drawing Sheets

(56) References Cited

OTHER PUBLICATIONS

Michael G. Schmidt et al., "Sustained Reduction of Microbial Burden on Common Hospital Surfaces through Introduction of Copper", J.Clin.Microbial, 50(7):2217-2223 (May 2012.

D. Blythe et al., "Environmental contamination due to methicillin-resistant *Staphylococcus aereus* (MRSA)", Journal of Hospital Infection, 38:67-69 (1998).

S. Ole et al., "Contamination of room door handles by methicillin-sensentive/methicillin-resistant *Staphylococcus aureus*", Journal of Hospital Infection, 51:140-143 (2002).

Ingersoll-Rand, "98/99 Series Rim Exit Devices", Von Duprin Parts Manual (Jun. 2005).

Yale, catalog p. 48, "architectural exit devices, accessories/options" (prior to May 2013).

* cited by examiner

COVER TRIM FOR A PUSH BAR OF AN EXIT DEVICE

CROSS REFERENCE TO RELATED APPLICATION

This invention claims the benefit of U.S. Provisional Patent Application No. 61/855,787; filed May 23, 2013, incorporated in full herein by reference.

BACKGROUND OF THE INVENTION

This invention relates to door latch devices, and more particularly to cover trims for a push bar of an exit device for a door, as well as to methods for their fabricating and installation.

A common complication of hospital care involves hospital-acquired infections from pathogenic microbes transmitted from and to hospital patients, staff and visitors via frequently touched environmental surfaces. Such surfaces, which include many types of commonly used door knobs and push plates, are recognized as reservoirs for the spread of such microbes notwithstanding hand hygienic and environmental cleaning practices for attempting to control infections.

It is well known that metallic copper surfaces are antimicrobial. See, for example, Michael G. Schmidt et al., "Sustained Reduction of Microbial Burden on Common Hospital Surfaces through Introduction of Copper", Journal of Clinical Microbiology, v. 50, n. 7, pp. 2217-2223 (July 2012), concluding that "reducing the overall microbial burden on a continuous basis with the introduction of continuously active antimicrobial copper surfaces, as evidenced in this study and others, may provide a safer environment for hospital patients, health care workers, and visitors."

A PowerPoint (registered trademark of Microsoft Corporation) presentation by Harold Michels (of Copper Development Association, Inc.), titled "Antimicrobial Properties of Copper Alloys and their Applications", reports testing results on solid copper and a variety of copper alloys containing between 60% and 95% copper. These tests showed a greater than 99% continuous reduction of bacterial contamination for solid copper as well as for each of the copper alloys. The U.S. Environmental Protection Agency (EPA) has currently issued public health registrations for antimicrobial copper to cover 479 copper alloys.

One type of frequently touched surfaces in hospital environments is the outer or touch surface of the push bar of an exit device secured to a normally latched hospital door. See for exampled, U.S. Pat. No. 4,167,280 of Godec et al., incorporated herein by reference. Although some door hardware made of copper alloys have been marketed, many push bars for door exit devices have been and are continued to be made of metals which have little or no antimicrobial properties, such as stainless steel and anodized aluminum. Consequently, a large number of such exit devices having non-antimicrobial push bars are installed in hospitals, schools and other public buildings.

SUMMARY OF THE INVENTION

According to one aspect of the present invention, there is provided a cover trim for a push bar of an exit device for a door, which cover trim is easily affixed to the push bar without requiring the disassembly of components of the exit device. The cover trim provides a new touch surface for the push bar. In its preferred embodiment, the cover trim is made of antimicrobial material, preferably a copper alloy meeting the public health registration requirements of the EPA, such as antimicrobial copper-based alloys marketed under the CuVerro trademark (registered trademark of GBC Metals, LLC).

The cover trim preferably comprises an elongate member configured to fit over the front surface and top and bottom edges of the push bar, and to be affixed thereto. In the preferred embodiment, the cover trim is fabricated of an elongate metal plate which is somewhat resilient, and the plate's longitudinal top and bottom edges are rearwardly bent for grasping and being held by the longitudinal top and bottom edges of the push bar.

When installing the cover trim, the installer may place the cover trim to the push bar with the cover trim's top rearwardly bent edge portion along and over the top edge of the push bar. The installer then urges the cover trim downwardly against the push bar's front surface until the cover trim's bottom rearwardly bent edge portion, aided by the resiliency of the cover trim, grasps or snaps onto the bottom edge of the push bar. Alternatively, the installer may first place the cover trim's rearwardly bent bottom edge portion along and under the push bar's bottom edge, and then urge the cover trim upwardly against the push bar's front surface until the cover trim's bent top edge portion grasps or snaps onto the push bar's top edge.

Another aspect of the present invention includes a method of installing a cover trim to a push bar of an exit device for a door, comprising: providing an exit device including a longitudinally extending push bar having a front surface; providing a cover trim including a longitudinally extending member configured for covering the push bar's front surface when the member is affixed to the push bar; and affixing the member to the push bar without disassembling components of the exit device. The cover member is preferably configured for resiliently grasping the push bar; and during the affixing step, the member is placed onto and grasping the push bar. In a preferred embodiment, the cover trim member is fabricated of an antimicrobial material, such as copper or a metal alloy containing copper.

Hand touching of polished metal surfaces, including copper alloy surfaces, tend to leave fingerprint markings on such surfaces. According to a further aspect of the present invention, there is provided a method for processing metal objects, including the copper alloy cover trim of the preferred embodiment, for increasing fingerprint resistance of the object's touch surface, comprising: providing a metal object with a surface having a polished finish; abrasive blasting (preferably sand blasting) the surface to a matte finish; and then repolishing the surface to a polished finish.

BRIEF DESCRIPTION OF THE DRAWINGS

The novel features believed to be characteristic of the invention, together with further advantages thereof, will be better understood by the following description considered in connection with the accompanying drawings in which preferred embodiments of the invention are illustrated by way of example. It is to be understood, however, that the drawings are for the purpose of illustration and description only and are not intended as a definition of the limits of the invention.

DETAILED DESCRIPTION OF THE PREFERRED EMBODIMENTS

Figure 1:
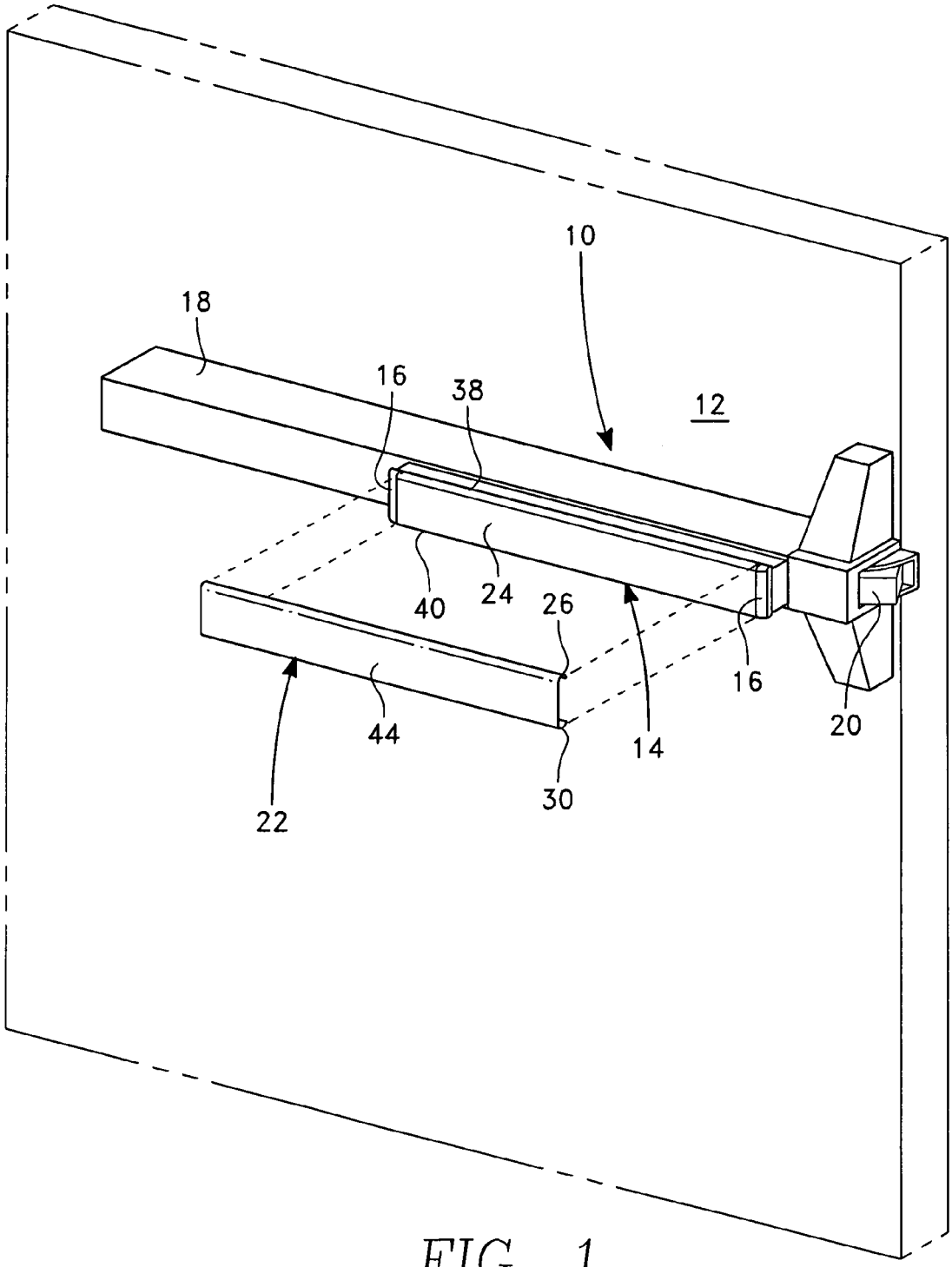
FIG. 1 is an isometric view of a preferred embodiment of a cover trim according to the present invention, shown for being affixed to the push bar of an exit device secured to a door, the door being shown in fragmentary isometric view.
Figure 2:
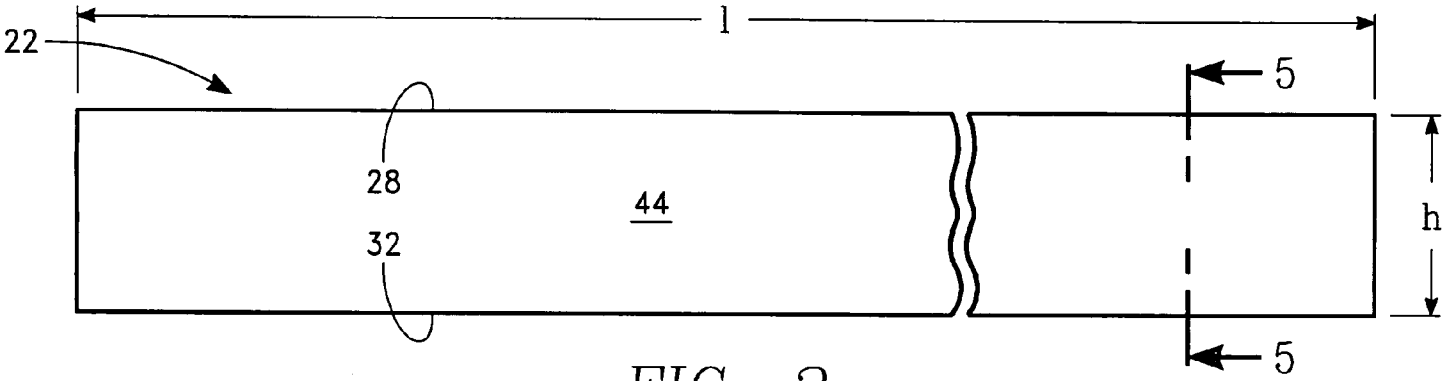
FIG. 2 is a rear elevation view of the cover trim of FIG. 1, shown in enlarged scale.
Figure 3:
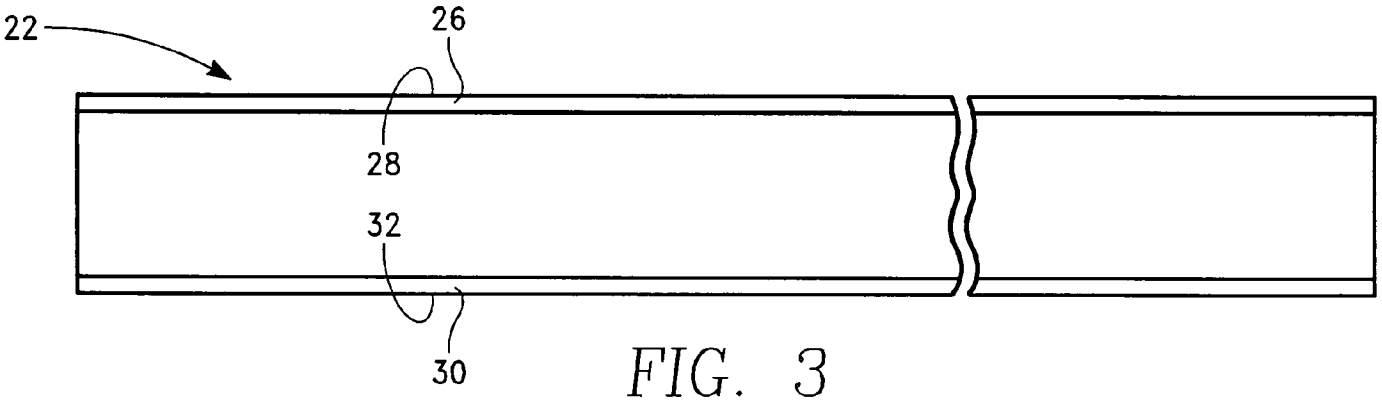
FIG. 3 is a rear elevation view of the cover trim of FIG. 2.
Figure 4:
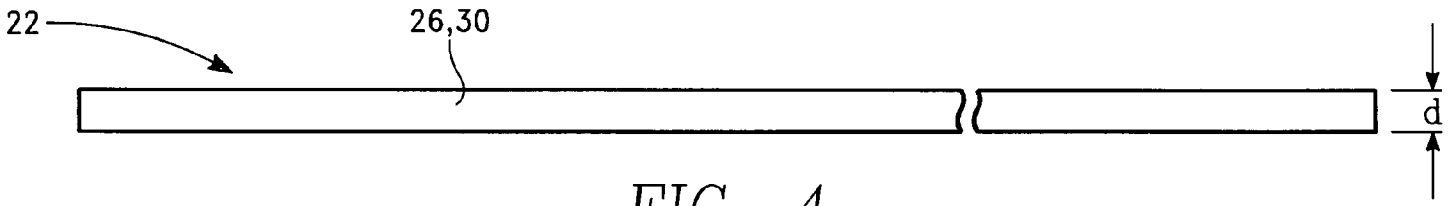
FIG. 4 is a top plan view of the cover trim of FIG. 2, the bottom plan view being substantially a mirror image.

Turning first to FIG. 1, there is illustrated an example of an exit device 10 secured to a door 12. The exit device 10 includes an elongate horizontally disposed push bar 14 supported, such as through end caps 16, for forward movement toward a mechanical case 18 of the exit device 10 when the push bar is pushed by a person to unlatch the latch 20 from a strike (not shown) mounted to the door frame (not shown). When released, the push bar 14 is caused to move away from the case 18, to the push bar's normal position for permitting the latch 20 to latch the strike when the door 12 is closed. Such exit devices are well known, for example as shown in U.S. Pat. No. 4,167,280, as well as exit devices marketed under the designation Von Duprin (registered trademark of Von Duprin, Inc.) 98/99 Series Rim Exit Devices.

A preferred embodiment of a cover trim 22 is shown in FIG. 1 in a general position for being installed on the push bar 14 of the exit device 10 while the exit device 10 is secured to the door 12. The cover trim 22 is configured for being affixed to the push bar 14 without the need for removing or disassembling any components of the exit device 10. The cover trim preferred embodiment 22 of FIG. 1 is shown in greater detail in FIGS. 2-5.

Turning to FIGS. 2-5 in combination with FIG. 1, the preferred cover trim 22 comprises a somewhat resilient rectangular sheet of material of thickness t, such as metal and preferably of copper or a copper alloy having antimicrobial properties. The cover trim 22 is elongate, of longitudinal dimension 1 and height dimension h configured to fit over the front or touch surface 24 of the push bar 14, between the end caps 16.

Figure 5:
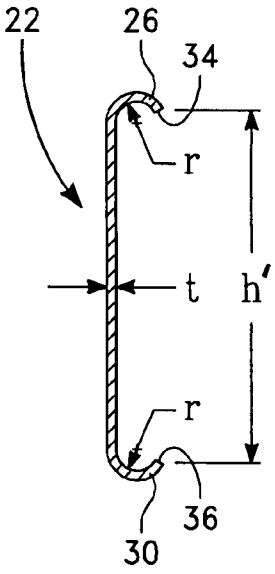
FIG. 5 is a cross-sectional view of the cover trim of FIG. 2, in further enlarged scale, taken along the line 5-5 of FIG. 2 in the direction of the appended arrows.

The cover trim 22 is configured with a top rearwardly bent portion 26 along its top edge 28, and with a bottom rearwardly bent portion 30 along its bottom edge 32. In the preferred embodiment, the top rearwardly bent edge portion 26 extends rearwardly by an outside depth d (see FIG. 4), and curves downwardly with an inside curvature of radius r (see FIG. 5); and the bottom rearwardly bent edge portion 30 extends rearwardly by an outside depth d (FIG. 4), and curves upwardly with an inside curvature of radius r (FIG. 5). The free end 34 of the rearward top edge portion 26 is separated from the free end 36 of the rearward bottom edge portion 30 by a vertical distance or height h'.

The actual dimensions 1, h, d, h' and r of a particular example of the above described cover trim 22 are determined by the corresponding dimensions of specific push bars of exit devices marketed by various manufacturers. For example, when used with Von Duprin 98/99 Series Rim Exit Devices having a push bar 14 of horizontal length (between end caps 16) of approximately 23.25 inches and a height of approximately 2.218 inches, for a cover trim 22 fabricated of CuVerro copper-nickel alloy sheet of nominal thickness t=0.028 inch, the following nominal dimensions appeared appropriate for suitably installing the cover trim 22 to such push bar 14: 1=23.25 inches, h=2.248 inches, d=0.455 inch, h'=1.930 inches and r=0.117 inch.

Returning to FIG. 1, the cover trim 22 is preferably installed on the push bar 14 of the exit device 10 secured to the door 12, by first placing the cover trim 22 to the push bar 14, between the end caps 16, with the inside curve of the cover trim's longitudinal rearwardly bent top edge portion 26 grasping or captively engaging the push bar's top edge 38. The installer then urges the cover trim 22 downwardly against the push bar's front surface 24 until, aided by the resiliency of the cover trim 22, the cover trim 22 flexes as the inside curve of the cover trim's longitudinal rearwardly bent bottom edge portion 30 grasps or captively engages the push bar's bottom edge 40. In such manner, the cover trim 22 is caused to snap onto and be retained by the push bar 14.

Alternatively, the cover trim 22 may be installed on the push bar 14 by first placing the cover trim 22 to the push bar 14, between the end caps 16, with the inside curve of the cover trim's longitudinal rearwardly bent bottom edge portion 30 grasping or captively engaging the push bar's bottom edge 40. The installer then urges the cover trim 22 upwardly against the push bar's front surface 24 until, aided by the resiliency of the cover trim 22, the cover trim 22 flexes as the inside curve of the cover trim's longitudinal rearwardly bent top edge portion 26 grasps or captively engages the push bar's top edge 38. In such alternative manner, the cover trim 22 is caused to snap onto and be retained by the push bar 14.

Figure 7:
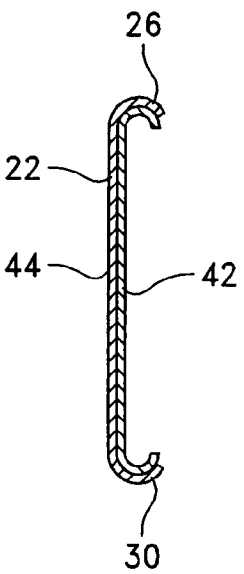
FIG. 7 is a cross-sectional view of the cover trim as in FIG. 5, installed on a cover plate or trim included in the push bar of FIG. 1.
Figure 6:
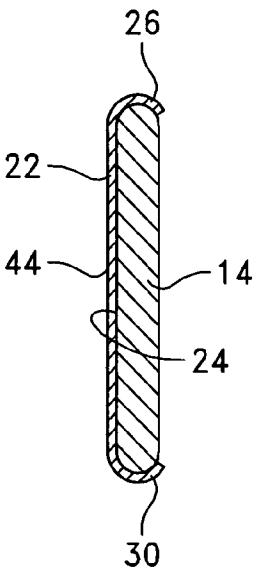
FIG. 6 is a cross-sectional view of the cover trim as in FIG. 5, showing the cover trim installed on the push bar (in cross-section) of FIG. 1, also in enlarged scale.

Affixation of the cover trim 22 to the push bar 14 is shown, in cross section in FIG. 6, wherein the push bar 14 is represented as a solid bar upon which the cover trim 22 is directly affixed. It is noted, however, that a push bar 14 may include its own secured cover plate or trim 42, to which the cover trim 22 of the present invention may be installed (see FIG. 7) in the manner described, i.e. by installing the cover trim 22 over the push bar's included cover plate or trim 42 without disassembling any components of the exit device. In any event, the cover trim 22 of the present invention provides a new touch surface 44 for the push bar 14, which new touch surface 44 is preferably antimicrobial.

Figure 8:
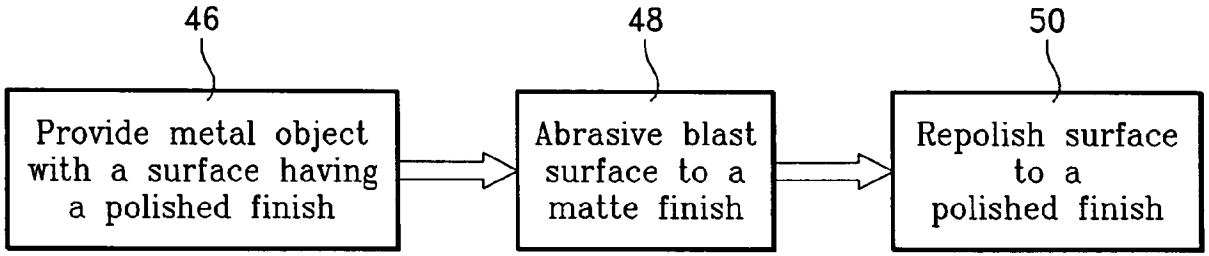
FIG. 8 is a flow diagram illustrating a method of increasing fingerprint resistance of a metal object such as the touch surface of the cover trim embodiment according to the present invention.

The touch surface 44 of the cover trim 22 of the present invention may further have increased resistance to fingerprints, when fabricated in accordance with a method featured by the present invention. Such method, which is shown in block flow diagram of FIG. 8, comprises the steps of providing a metal object with a surface having a polished finish (46); abrasive blasting the surface to a matte finish (48); and repolishing the surface to a polished finish (50).

As applied to the preferred cover trim 22 of the present invention, the providing step (46) includes providing a sheet of a metal alloy having a polished surface (preferably an antimicrobial copper alloy such as a copper-nickel alloy) and fabricating the cover trim 22 therefrom. The outside touch surfaces (front 24 and edge portions 26, 30) are then sand blasted to a matte finish (48), and those surfaces are repolished (such as by belt polishing) to a polished finish (50). One example of a polished finish in either or both of steps 46 and 50 is a satin finish, such as a No. 4 satin finish.

It has been found that the touch surfaces of copper-nickel alloy cover trim examples fabricated in accordance with this method have demonstrated increased resistance to fingerprint markings.

In the abrasive blasting step (48), particles other than sand may be utilized, for example glass beads or steel shot may be employed as blasting material.

Thus, there has been described a preferred embodiment of a cover trim for a push bar of an exit device for a door, which cover trim is preferably antimicrobial and may be easily installed on the push bar without disassembling any components of the exit device. There has been further described a method for increasing fingerprint resistance of metal object surfaces, and in particular the touch surface of the cover trim preferred embodiment. Other embodiments of the present invention and variations of the embodiments and methods presented herein may be developed without departing from the essential characteristics thereof. Accordingly, the invention should be limited only by the scope of the claims listed below.

We claim:

1. A cover trim for a push bar of an exit device for a door, the push bar operatively supported in the exit device for forward movement to unlatch the door when the exit device is secured to the door and the push bar is pushed by a person, the cover trim comprising:

an elongate plate member configured for covering the push bar when affixed thereto, said member configured for being affixed to the push bar without disassembly of components of the exit device.

2. The cover trim according to claim 1, wherein:

said member is resilient and configured for snapping onto the push bar for being affixed thereto.

3. The cover trim according to claim 1, wherein:

said member includes longitudinal edges configured for resiliently capturing longitudinal edges of the push bar when said member is placed to the push bar between ends thereof and urged against a front surface thereof.

4. The cover trim according to claim 3, wherein:

said longitudinal edges of said member are rearwardly bent.

5. The cover trim according to claim 1, wherein:

said member includes a fingerprint resistant touch surface.

6. The cover trim according to claim 1, wherein:

said member is of a metal with a surface having a polished finish, abrasive blasting said surface to a matte finish, and repolishing said surface to a polished finish, thereby increasing fingerprint resistance of said surface.

7. The cover trim according to claim 6, wherein:

said metal includes at least 60% copper.

8. The cover trim according to claim 6, wherein:

said metal comprises an alloy containing nickel and at least 60% copper.

9. The cover trim according to claim 1, the exit device including end caps for the ends of the push bar, wherein:

said member includes longitudinal edges configured for resiliently capturing longitudinal edges of the push bar when said member is placed to the push bar between the end caps and urged against a front surface of the push bar.

10. The cover trim according to claim 1, the push bar including a secured cover plate, wherein:

said member is configured for being affixed to the push bar over the secured cover plate.

11. The cover trim according to claim 1, the push bar including a secured cover plate covering a front surface of the push bar, wherein:

said member includes longitudinal edges configured for resiliently capturing longitudinal edges of the secured cover plate when said member is placed to the secured cover plate between ends of the push bar and urged against a front surface of the secured cover plate.

12. The cover trim according to claim 1, wherein:

said member includes a rearwardly bent top longitudinal edge and a rearwardly bent bottom longitudinal edge configured for resiliently capturing a top longitudinal edge and a bottom longitudinal edge of the push bar when said member is placed to a front surface of the push bar with said top edge of said member captively engaging the top edge of the push bar and said member is urged downwardly against the front surface of the push bar.

13. The cover trim according to claim 1, wherein:

said member includes a rearwardly bent top longitudinal edge and a rearwardly bent bottom longitudinal edge configured for resiliently when said member is place to a front surface of the push bar with said bottom edge of said member captively engaging the bottom edge of the push bar and said member is urged upwardly against the front surface of the push bar.

14. The cover trim according to claim 1, wherein:

said member is of antimicrobial material.

15. The cover trim according to claim 1, wherein:

said member is of a metal containing at least 60% copper.

16. Apparatus comprising the combination of:

an exit device including a latch for normally maintaining a door in a latched condition when said exit device is secured to the door, said exit device including an elongate push bar having a front surface, said push bar coupled to said latch and supported for forward movement when said front surface is pushed by a person to unlatch the door; and a cover trim including an elongate plate member configured for being affixed to said push bar for covering said front surface without disassembly of components of said exit device.

17. The apparatus according to claim 16, wherein:

said plate member is resilient and configured for snapping onto said push bar for being affixed thereto.

18. The apparatus according to claim 16, wherein:

said push bar is supported between end caps included by said exit device; and said plate member includes longitudinal edges configured for resiliently capturing longitudinal edges of said push bar when said plate member is placed to said front surface between said end caps and urged against said front surface.

19. The apparatus according to claim 16, wherein:

said push bar includes a top longitudinal edge and a bottom longitudinal edge; and said plate member includes a rearwardly bent top longitudinal edge and a rearwardly bent bottom longitudinal configured for resiliently capturing said top longitudinal edge and said bottom longitudinal edge respectively of said push bar when said plate member is placed to said front surface of said push bar with said top edge of said plate member captively engaging said top edge of said push bar and said plate member is urged downwardly against said front surface.

20. The apparatus according to claim 16, wherein:

said push bar includes a top longitudinal edge and a bottom longitudinal edge; and said plate member includes a rearwardly bent top longitudinal edge and a rearwardly bent bottom longitudinal edge configured for resiliently capturing said top longitudinal edge and said bottom longitudinal edge respectively of said push bar when said plate member is placed to said front surface of said push bar with said bottom edge of said plate member captively engaging said bottom edge of said push bar and said plate member is urged upwardly against said front surface.

21. The apparatus according to claim 16, wherein:

said plate member is of antimicrobial material for providing an antimicrobial touch surface for said push bar when affixed thereto.

22. The apparatus according to claim 21, wherein:

said plate member is of a metal alloy containing at least 60% copper.

23. The apparatus according to claim 16, wherein:

said push bar includes a secured cover plate; and said plate member is configured for being affixed to said push bar over said secured cover plate.

24. The apparatus according to claim 16, wherein:

said push bar includes a secured cover plate covering said front surface; and said plate member includes longitudinal edges configured for resiliently capturing longitudinal edges of said secured cover plate when said plate member is placed to said secured cover plate between ends of said push bar and urged against a front surface of said secured cover plate.

* * * * *